United States Patent [19]

Buzzard et al.

[11] 4,254,939

[45] Mar. 10, 1981

[54] SAFETY DEVICES FOR LOAD LIFTING AND LOWERING APPARATUS

[75] Inventors: Michael A. Buzzard, Letchworth; Ian Michael D. Gaylor, Harpenden, both of England

[73] Assignee: Ratcliff Tail Lifts Limited, Welwyn Garden City, England

[21] Appl. No.: 42,430

[22] Filed: May 25, 1979

[30] Foreign Application Priority Data

May 31, 1978 [GB] United Kingdom ..... 24973/78

[51] Int. Cl.[3] ..... B66F 7/12

[52] U.S. Cl. ..... 254/89 R; 187/8.47

[58] Field of Search ..... 187/8.47, 8.49, 8.5; 254/1, 89 R

[56] References Cited

U.S. PATENT DOCUMENTS 2,843,223 7/1958 Villars ..... 187/8.47

*Primary Examiner*—Robert C. Watson

*Attorney, Agent, or Firm*—Young & Thompson

[57] ABSTRACT

A safety device for load lifting and lowering apparatus of the kind comprising a pair of parallel spaced apart upright guide members of hollow section along each of which travels a runner mounted on a load carrier, a cable being connected to each runner to pull it upwardly along the guide member or lower it down the guide member, comprises pawls rotatably mounted on the runner and a block slidable relative to the pawl to which the cable is connected. Levers are pivotally mounted one on each pawl and one end of each lever is pivotally and slidably connected to the block. Springs urge the block towards the runner. Each pawl has a tapered edge and a roller which rests in normal use in a recess. In normal operation tension in the cable separates the block from the runner but when the tension is released, the springs urge the block towards the runner thereby rotating the levers and thereby moving the roller upwardly so that the pawls are jammed against the walls of the guide member.

8 Claims, 3 Drawing Figures

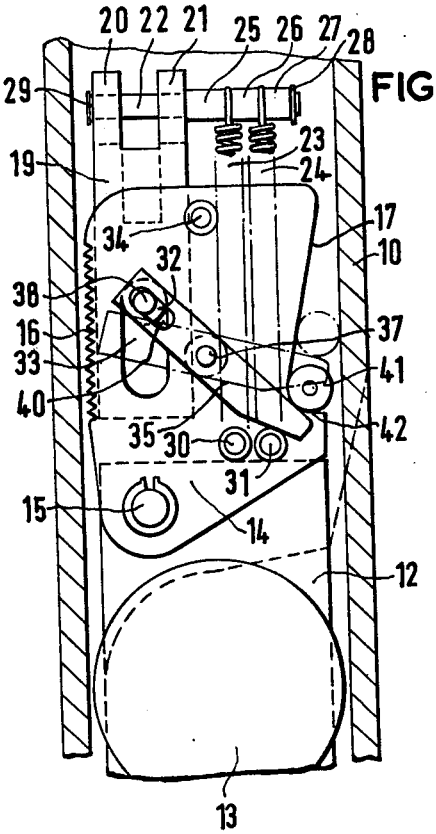
FIG. 1
FIG. 2.
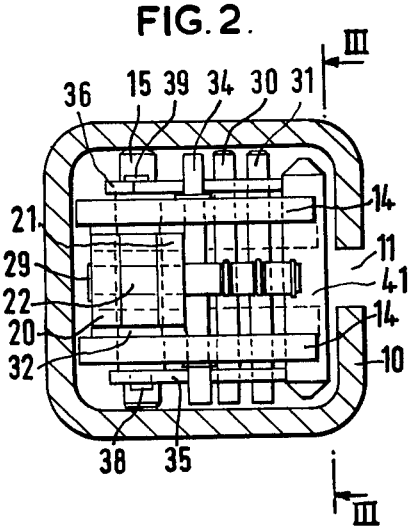
FIG. 3.
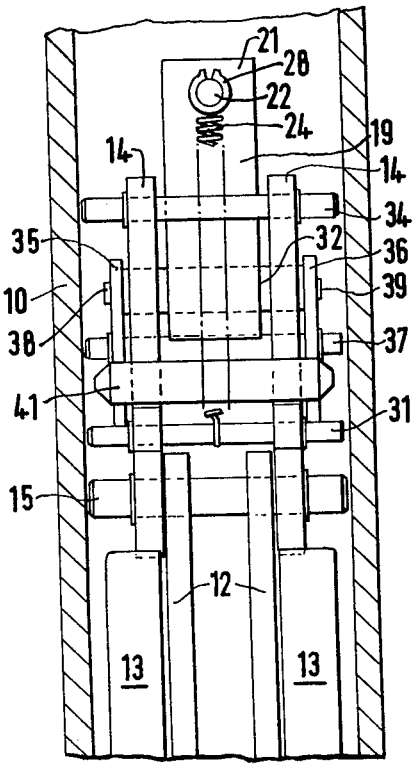

SAFETY DEVICES FOR LOAD LIFTING AND LOWERING APPARATUS

BACKGROUND OF THE INVENTION

The invention relates to safety devices for load lifting and lowering apparatus of the kind comprising a pair of parallel spaced apart upright guide members of hollow section along each of which travels a runner mounted on a load carrier, there being provided a cable connected to each runner to pull it upwardly along the guide member or lower it down the guide member, so as to raise or lower the load carrier. Such apparatus will hereinafter be referred to as "load lifting and lowering apparatus of the kind described". More particularly but not exclusively, the invention relates to vehicle tail lifts for raising and lowering loads at the rear end of a vehicle.

The term "cable" where used in this specification includes chains, ropes, bands and any other flexible elements suitable for use in raising and lowering a load carrier.

SUMMARY OF THE INVENTION

According to the invention there is provided load lifting and lowering apparatus of the kind described in which at least one runner has pivotally mounted on it pawl means to which the cable is indirectly connected through cable connection means slidably mounted on the pawl means, spring means urging the cable connection means towards the runner, the pawl means having one edge tapered relative to the adjacent wall of the guide member, the apparatus further comprising locking means movable relative to the pawl means between said tapered edge and the adjacent wall of the guide member and means to move the locking means in accordance with the spacing of the cable connection means from the runner such that upward movement of the locking means engages the pawl means in the guide member with a jamming fit, the arrangement being such that the pawl means is held out of frictional engagement with the guide member by tension in the cable, and when tension in the cable is released the spring means urges the cable connection means towards the runner, causing said movable locking means to move upwardly relative to the tapered edge of the pawl means to engage the pawl means with the guide member by a jamming fit.

The means to move the locking means may comprise a lever pivotally mounted intermediate its ends on the pawl means, the lever being pivotally connected at one end to the cable connection means and movement of the cable connection means towards the runner causing rotation of the lever about the pivotal mounting on the pawl means such that the other end of the lever moves the locking means relative to the pawl means to engage the pawl means with the associated guide member.

The lever is preferably pivotally and slidably connected to the cable connection means.

The spring means are preferably connected at one end to the cable connection means and at the other end to the pawl means.

The edge of the pawl means opposite to the tapered edge is preferably serrated.

The pawl means preferably comprises a pair of pawls of similar shape arranged one each side of the runner, and the pawls are preferably each connected to a common cable connection means and lockable by a single locking means engageable with both tapered pawl edges.

The locking means may comprise a roller, and the roller may have a roughened surface.

The invention further provides a vehicle comprising load lifting and lowering apparatus according to the invention, the load lifting and lowering apparatus preferably being constructed as a vehicle tail lift.

BRIEF DESCRIPTION OF DRAWINGS

By way of example, one embodiment of load lifting and lowering apparatus according to the invention will now be described with reference to the accompanying drawings in which:

FIG. 1 is a sectional side view of part of a vertical guide member of a load lifting and lowering apparatus:

FIG. 2 is a sectional plan view of the part of the guide member shown in FIG. 1; and FIG. 3 is a sectional view along the line III—III of FIG. 2.

DESCRIPTION OF PREFERRED EMBODIMENT

A guide member 10 is a vertical box section tube of metal, for example mild steel. On side wall of the guide member 10 is formed with a slot 11 through which a support for a load carrying platform (not shown) passes for connection to runners 12 slidable up and down within the guide member 10. Each runner 12 has a roller 13 rotatably mounted on it.

Rotatably mounted on each runner 12 is a pawl 14, the pawls 14 comprising flat metal sheets of the same shape. The pawls 14 are rotatably supported on a common shaft 15 passing through the runners 12. Each pawl has a serrated edge 16 and a tapered edge 17, the arrangement of the tapered edge 17 being such that the spacing between the pawl 14 and the guide member 10 diminishes as the top of the pawl is approached.

Slidably mounted on the pawl is cable connection means in the form of a metal block 19 having two flanges 20, 21 between which extends a shaft 22 to which a cable (not shown) is attached in an assembled apparatus. The shaft 22 extends beyond the flange 21 to provide a support for a pair of springs 23, 24. Sleeves 25, 26, 27 serve to position the springs on the shaft 22 and a ring 28 secured to the shaft 22 holds the sleeves in position. The end 29 of the shaft 22 adjacent the flange 20 is peened to provide an annular abutment to prevent the shaft sliding through the flange 20. The other ends of the springs 23, 24 are secured to shafts 30, 31 secured to the pawls 14.

The cable connection means is urged towards the pawl by tension in the springs 23 and 24, relative movement of the cable connection means and the pawl being limited by a further shaft 32 passing through and extending beyond the block 19, extensions of the further shaft 32 each engaging a slot 33 in the associated pawl 14. A guide shaft 34 secured to the two pawls ensures that while there is tension in the cable, the pawls 14 and the block 19 may only move vertically.

Pivotally mounted on a shaft 37 secured to the two pawls 14 are levers 35, 36 there being one lever associated with each pawl 14. One end of both levers 35, 36 is pivotally and slidably connected to the further shaft 32 by means of extensions 38, 39 of the further shaft 32 engaging slots 40 in the levers 35, 36 respectively. Thus it will be appreciated that movement of the block 19 towards the pawl 14 causes the levers 35, 36 to rotate anti-clockwise when viewed in the direction of FIG. 1.

The other ends of the levers 35, 36 lie against a metal roller locking member 41 which lies in recesses 42 in the pawls 14 when there is tension in the cable to pull the pawls and cable support means apart. The roller 41 has a surface roughened by, for example, milling. The diameter of the roller 41 is such that if it is moved upwards relative to the pawls, the roller will frictionally engage the tapered edges of the pawls and the adjacent wall of the guide member 10.

In use, when there is tension in the cable, the force exerted by the springs is overcome and block 19 is maintained at its maximum displacement from the pawls 14, with the shaft 32 engaging the top of the slots 33 in the pawls and the roller 41 resting in the recess 42. If, however, the tension in the cable is released, caused for example by the cable breaking, the springs 23, 24 urge the block 19 towards the pawls 14, causing the shaft 32 to move down the slots 33 and consequently causing rotation of the levers 35, 36 about the shaft 37. As the levers rotate, the other ends of the levers engage and lift the roller 41 relative to the pawls 14 until there is frictional engagement between the roller and the adjacent wall of the guide member 10. At this point, further upward movement of the roller relative to the pawls causes rotation of the pawls about the shaft 15 to engage the serrated edges 16 of the pawls with the adjacent walls of the guide member. After this engagement of the serrated edges 16 of the pawls, any further downward movement of the runner caused by the weight of the platform and any goods supported on it urges the roller 41 into a tighter jamming fit between the tapered edges 17 of the pawls and the adjacent wall of the guide member to prevent the platform falling.

The advantage of this embodiment of the invention is that a locking safety device is provided which comes into operation when tension in the cable is released, for example by the cable breaking, but which is positively constrained to remain out of locking engagement when there is sufficient tension in the cable to extend the springs. Any possibility of the device coming into operation by, for example, vibrations or flexing of the cable is removed.

We claim:

1. Load lifting and lowering apparatus comprising a pair of parallel spaced apart upright guide members of hollow section, a pair of runners each movable along one of the guide members and each mounted on a load carrier, and a cable connected to each runner for pulling the runners upwardly along the guide members or lowering the runners down the guide members to respectively raise or lower the platforms, wherein at least one runner has pivotally mounted on it pawl means to which the cable is indirectly connected through cable connection means slidably mounted on the pawl means, spring means urging the cable connection means towards the runner, the pawl means having one edge tapered relative to an adjacent wall of the guide member, the apparatus further comprising locking means movable relative to the pawl means between said tapered edge and said adjacent wall of the guide member and means to move the locking means in accordance with the spacing of the cable connection means from the runner such that upward movement of the locking means engages the pawl means in the guide member with a jamming fit, the arrangement being such that the pawl means is held out frictional engagement with the guide member by tension in the cable, and when tension in the cable is released the spring means urges the cable connection means towards the runner, causing said movable locking means to move upwardly relative to the tapered edge of the pawl means to engage the pawl means with the guide member by a jamming fit.

2. Load lifting and lowering apparatus as claimed in claim 1 wherein the means to move the locking means comprises a lever pivotally mounted intermediate its ends on the pawl means, the lever being pivotally connected at one end to the cable connection means and movement of the cable connection means towards the runner causing rotation of the lever about the pivotal mounting on the pawl means such that the other end of the lever moves the locking means relative to the pawl means to engage the pawl means with the associated guide member.

3. Load lifting and lowering apparatus as claimed in claim 2 wherein the lever is pivotally and slidably connected to the cable connection means.

4. Load lifting and lowering apparatus as claimed in claim 1 wherein the spring means are connected at one end to the cable connection means and at the other end to the pawl means.

5. Load lifting and lowering apparatus as claimed in claim 1 in which the edge of the pawl means opposite to the tapered edge is serrated.

6. Load lifting and lowering apparatus as claimed in claim 1 wherein the pawl means comprises a pair of pawls of similar shape arranged one each side of the runner, the pawls being connected to a common cable connection means and lockable by a single locking means engageable with both tapered pawl edges.

7. Load lifting and lowering apparatus as claimed in claim 1 wherein the locking means comprises a roller.

8. Load lifting and lowering apparatus as claimed in claim 7 wherein the roller has a roughened surface.

* * * * *